US006414444B2

(12) United States Patent
Fox et al.

(10) Patent No.: US 6,414,444 B2
(45) Date of Patent: Jul. 2, 2002

(54) FIELD-EMISSION DISPLAY

(75) Inventors: Neil Anthony Fox, Cheltenham; Wang Nang Wang, Lympley Stoke, both of (GB)

(73) Assignee: Smiths Group PLC, London (GB)

( * ) Notice: Subject to any disclaimer, the term of this patent is extended or adjusted under 35 U.S.C. 154(b) by 0 days.

(21) Appl. No.: 09/813,831

(22) Filed: Mar. 22, 2001

(30) Foreign Application Priority Data

Mar. 22, 2000 (GB) ..... 0006762

(51) Int. Cl.[7] ..... G09G 3/10

(52) U.S. Cl. ..... 315/169.3; 315/169.1; 313/495; 313/498; 313/503; 345/55; 345/74; 345/75

(58) Field of Search ..... 315/169.3, 169.1, 315/169.4; 313/495, 498, 503; 345/55, 60, 66, 67, 76, 74, 75

(56) References Cited

U.S. PATENT DOCUMENTS 5,747,918 A * 5/1998 Eom et al ..... 313/309
5,763,997 A 6/1998 Kumar ..... 313/495
6,031,336 A * 2/2000 Rumbaugh et al. ..... 315/169.3
6,184,627 B1 * 2/2001 Hamada et al. ..... 315/169.4
6,252,569 B1 * 6/2001 Hodson et al. ..... 345/75.2
6,307,327 B1 * 10/2001 Xie et al. ..... 315/169.4

FOREIGN PATENT DOCUMENTS

JP 10-92347 4/1998

* cited by examiner

*Primary Examiner*—Don Wong
*Assistant Examiner*—Tuyet T. Vo
(74) *Attorney, Agent, or Firm*—Connolly Bove Lodge & Hutz, LLP

(57) ABSTRACT

Parallel cathode electrodes extend across the base plate of a display. Each electrode has teeth projecting from both sides, the teeth of adjacent electrodes being closely spaced from one another by a gap that is bridged by a dot of an electron emitter material. A glass screen spaced by a vacuum gap above the base plate carries transparent anode stripes extending transversely of the cathode electrodes and a fluorescent layer of colored phosphors on the anode stripes. A voltage applied between adjacent cathode electrodes and gates conduction via each electron emitter dot. A voltage applied to an anode stripe causes a part of the current from the emitter directly below the stripe to be directed towards the anode, thereby illuminating the phosphor pixel above the emitter.

9 Claims, 3 Drawing Sheets

FIELD-EMISSION DISPLAY

BACKGROUND OF THE INVENTION

This invention relates to displays.

The recent application of flat panel displays in portable electronic products has renewed interest in developing low cost, high performance technologies such as flat cathode ray tubes and field-emitter displays (FEDs). FED panels are of particular interest because they can exhibit the most desirable aspects of a CRT. That is, they are emissive, they can have a full range of colours and grey scale, and have a wide viewing angle and high resolution. In addition, this display technology is thin, light-weight, rugged, is matrix addressed and requires only low power. Furthermore, FED panels will not generate X-rays if operated at low to moderate (5 kV) anode voltages.

In 1991 a research team at LETI, lead by Robert Meyer demonstrated the first colour flat panel based on the microtip Field Emission Array (FEA) proposed by Cap Spindt at SRI in 1968. This display used a large number of very fine micro-tip cold cathodes as the sources of electrons. Each pixel can be addressed independently to release electrons which are accelerated towards a phosphor-coated anode faceplate positioned above the FEA, to produce a cathodoluminescent image. Sub-micron sized microtips and concentric grids are necessary to achieve locally enhanced electric field strengths of up to 500V/micron at gate voltages of 40 to 80 volts from metal cathodes which have a work function of 4.5 eV.

Low cost production of large area panels using this micro-tip triode structure has proven to be difficult because of the need to fabricate a high density of microscopically sharp tips to obtain the best emission efficiency. Sub-micron features must be fabricated over large areas, which dramatically increases the cost of capital equipment. Existing, vertically-gated microtip field emitter arrays (FEA) also suffer from significant current leakage between the gate and emitter electrode through the dielectric film separating them. Such leakage occurs due to the high field strengths generated between the gate and emitter lines necessary to cause emission from the gated metal tips. Current leakage is a significant problem in FEDs because, in addition to the dissipative losses, the capacitive load introduced across the dielectric can affect the speed of response of the emitter when it is being addressed. This leakage effect also complicates the drive circuits needed.

BRIEF SUMMARY OF THE INVENTION

It is an object of the present invention to provide an alternative display.

According to one aspect of the present invention there is provided a display including a cathode emitter base plate having a plurality of gated, cathode structures of linear form, each cathode structure having a pair of electrodes separated from one another by a gap and having a plurality of electron field emitter sites spaced along its length, such that when a cathode structure is addressed with a voltage, all of the emitter sites along the addressed cathode are gated to conduct current across the gap, the display including a screen separated from the base plate by a vacuum gap, and the screen having a fluorescent layer and having a plurality of addressable anode stripes extending transversely of the cathode structures such that a voltage applied to an anode stripe causes a portion of the electron current at a conducting emitter site below the stripe to be redirected towards the screen to cause illumination of a pixel on the fluorescent layer.

Each electrode of the cathode structures preferably includes a plurality of teeth projecting from opposite sides towards an adjacent electrode, the electron emitter sites being located between teeth of adjacent electrodes. Each electron emitter site is preferably provided by a dot of material bridging the gap between the pairs of electrodes of the cathode structure. The material may be selected from a group comprising: semiconducting diamond, nanotube carbon, gallium nitride and metal oxides. The anode stripes are preferably transparent to light emitted by the fluorescent layer, which is preferably formed on the anode stripes. The fluorescent layer may include regions of phosphors that fluoresce with different colours arranged such that a full colour picture can be displayed. The screen may have a black material between the fluorescent pixels.

A display according to the present invention will now be described, by way of example, with reference to the accompanying drawings.

DETAILED DESCRIPTION OF THE PREFERRED EMBODIMENT

Figure 1:
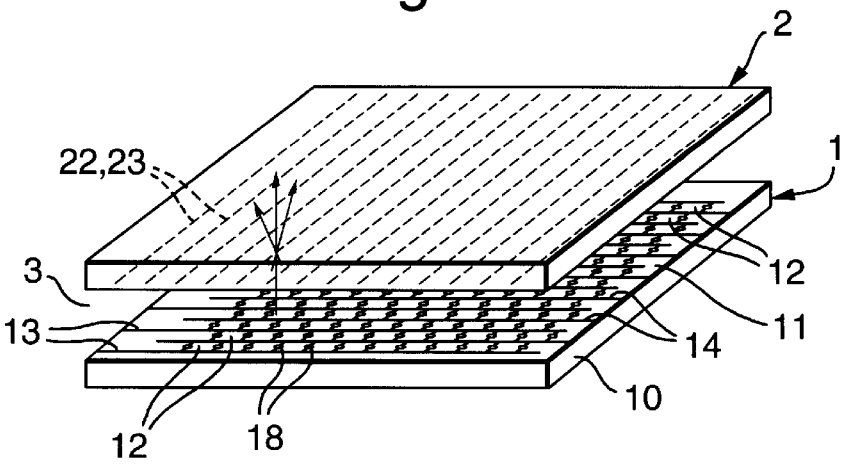
FIG. 1 is a perspective, simplified view of the display.
Figure 2:
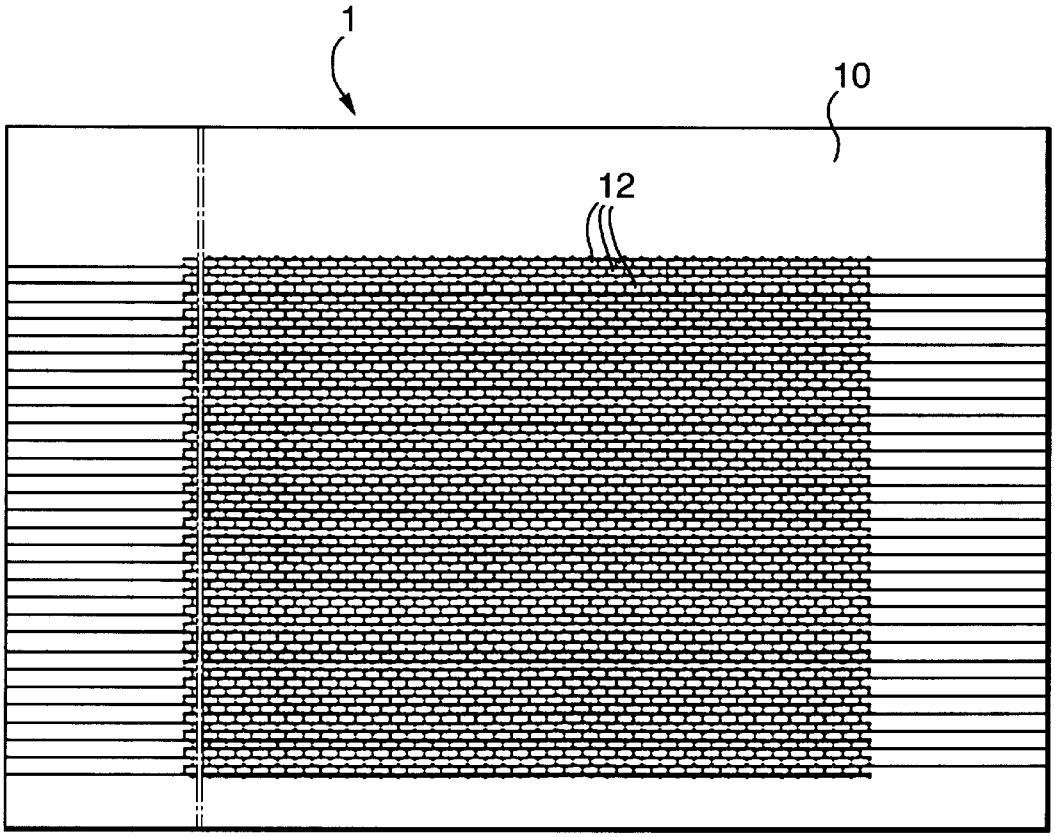
FIG. 2 is a more detailed plan view of the base plate.

The display comprises a base plate 1 and a faceplate or screen 2 extending parallel with the base plate and spaced a small distance from it by a vacuum gap 3. The faceplate 2 is sealed with and supported on the base plate 1 around its edge (not shown). The faceplate 2 is supported internally by small, spherical glass spacers approximately 200 to 500 $\mu$m in diameter, which are incorporated into the lower surface of the face plate.

Figure 3:
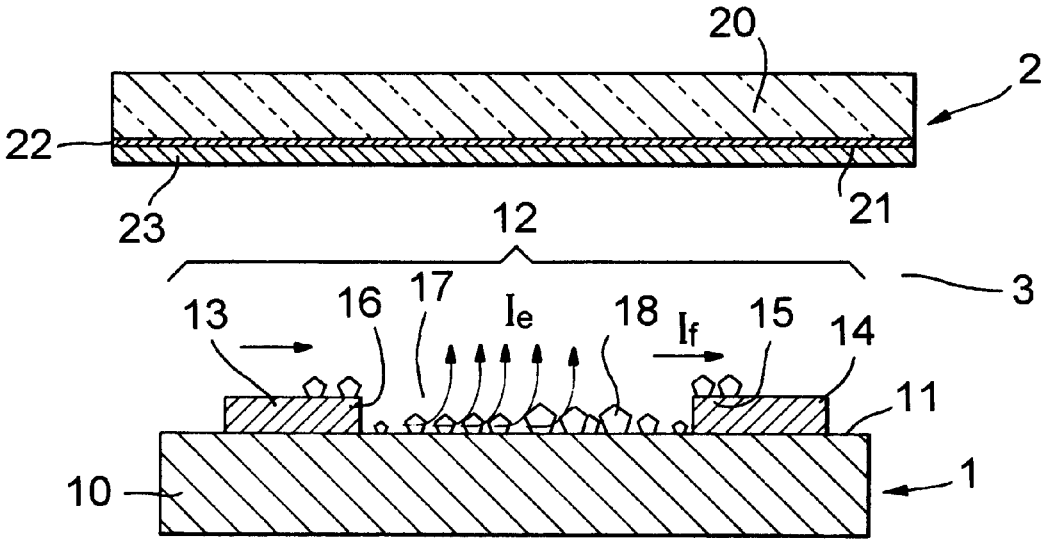
FIG. 3 is an enlarged sectional side elevation view of a part of the display along one of the anode stripes and transversely of a cathode structure.
Figure 3A:
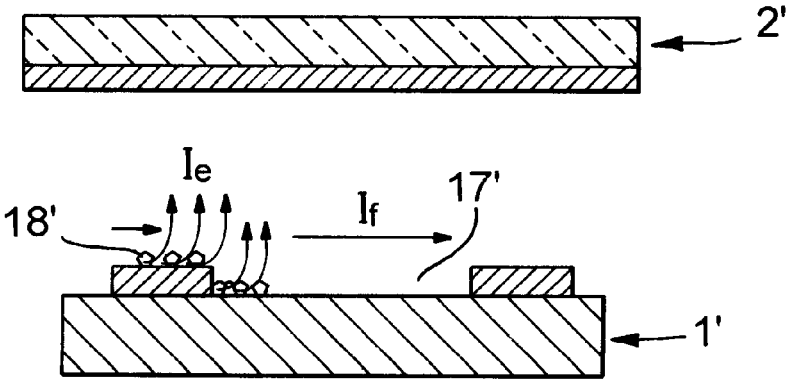
FIG. 3A shows an alternative arrangement.
Figure 4:
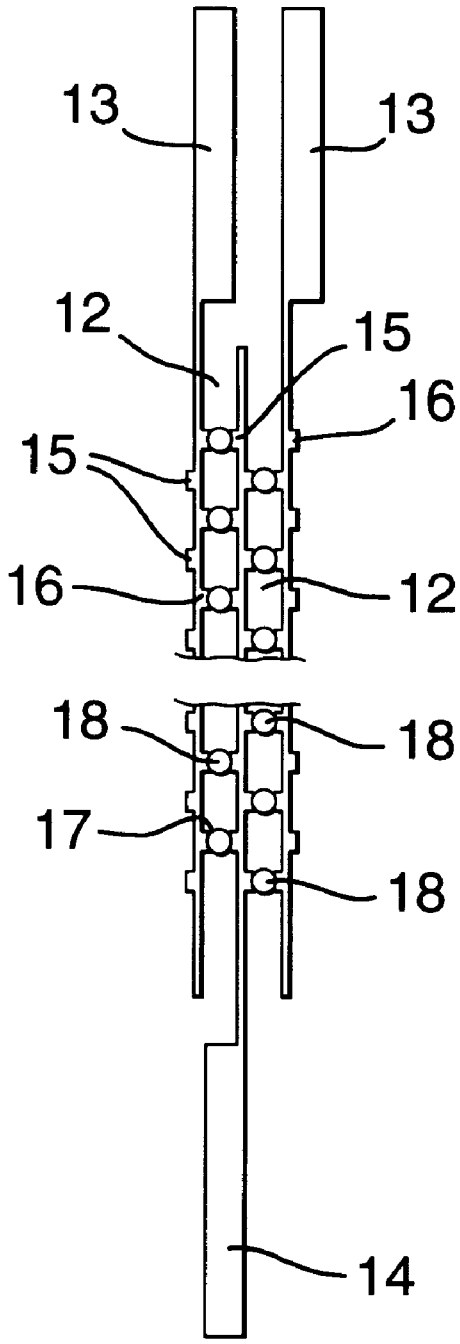
FIG. 4 is an enlarged plan view of two of the cathode structures.

The base plate 1 has a substrate 10 of an electrically-insulative material supporting on its upper surface 11 about fifty cathode structures 12, although many more cathode structures may be used in larger displays. The cathode structures 12 have a linear form extending parallel to one another and to an edge of the base plate 1. Each cathode structure 12 has a pair of parallel, elongate metal electrodes 13 and 14, such as of platinum, extending across the base plate 1 from opposite edges. Each electrode 13 and 14 has a number of short teeth 15 and 16 projecting outwardly along opposite sides, the teeth being spaced from one another and those on one side being interposed between those on the other side. In this way, the teeth 16 on one side of one electrode 13 align with the teeth 15 on the opposite side of an adjacent electrode 14 and are spaced laterally from one another by a small gap 17 of about 10 microns in width. The electrodes 13 and 14 can be formed on the base plate I using conventional lithographic techniques. The cathode structures 12 are completed by a small dot 18 of an electron emitter material deposited to bridge each gap 17 and overlap the teeth 15 and 16, forming an electron emitter site. Alternatively, as shown in FIG. 3A, the electron emitter material 18' may only partially bridge the gap 17'.

Various different materials can be used for the electron emitter material, such as: nano-particle, semiconducting diamond; nano-particle carbon formed from nanotubes;

nano-particle gallium nitride; or nano-particle metal oxides such as magnesium oxide, zinc oxide or zirconium oxide. The dots of material could be deposited on the base plate in various ways, such as, for example by ink jet printing, by electrophoresis or, in the case of metal oxides, by dc or rf sputtering of an appropriate target material.

After deposition of the electron emitter material dots 18, the emitters are conditioned by a suitable activation process. Diamond is subject to nitrogen or argon plasma treatment followed by flash coating with a layer of particles about 2 to 5 angstrom in diameter of titanium, zirconium or some other metal that induces negative electron affinity in diamond. Suitable metals are those having a strong affinity for carbon and forming a Schottky barrier height at the metal/diamond interface that is less that 0.2 eV. If carbon nanotubes are used as the emitter material, this is subject to nitrogen or argon plasma treatment. Gallium nitride is also treated with nitrogen or argon plasma followed by a flash coating of 2–5 angstroms diameter particles of indium, titanium or aluminium to induce a negative electron affinity surface effect. Where metal oxide is used it is preferably deposited on electrodes made of platinum and is thermally annealed in an air furnace at about at least 500–600° C.

The faceplate or screen 2 has a transparent plate 20, such as of glass, with a lower surface 21 on which is deposited a number of parallel anode stripes 22 of a thin, transparent metal, such as ITO, each stripe being coated with a fluorescent layer of a phosphor material 23. In a colour display, the phosphors on adjacent stripes 22 would be of three different kinds such that each fluoresces with a different colour when electrons impinge. The anode stripes 22 extend orthogonally transversely of the cathode structures 12 and each is located directly above one of the emitter dots 18, that is, the number of anode stripes is equal to the number of electron emitters along a cathode structure. Regions between the phosphor stripes are printed with a matrix of black material to form a mask around the phosphor regions. This technique is used conventionally in other emissive displays, such as electroluminescent and vacuum fluorescent displays, to enhance contrast.

To cause a pixel to be brightened on the screen 2, a voltage is applied between those two electrodes 13 and 14 extending directly below the pixel. This causes all the emitter sites 18 along the addressed cathode structure to be gated and current to flow between the electrodes 13 and 14. At the same time, a positive voltage is applied to that anode stripe 22 along which the pixel is located. Where the anode stripe 22 extends directly above the addressed cathode structure 12, the electric field $I_f$ caused by the voltage applied to the strip is sufficient to induce the electron current flowing at the intersecting emitter site 18 to be redirected vertically upwards $I_e$ towards the anode. Electrons liberated from the emitter site 18 travel without collision across the vacuum gap 3 and impinge on the phosphor layer 23 the anode stripe 22. This causes the phosphor 23 to fluoresce in the visible part of the spectrum and the light produced passes through the anode 22 to appear as a small bright dot or pixel on the screen 2. By appropriately addressing different combinations of anode stripe and cathode structure any pixel can be brightened to produce a desired display representation.

Because the arrangement of the present invention does not require an insulating layer to stand off a voltage between two address electrodes, current leakage is reduced, thereby preventing any reduction in the speed of response of the emitter and simplifying the drive circuit used to address the display. The emitter material can be gated to emit at a lower voltage than a vertically-gated Spindt triode so that the display can be operated at lower voltages, similar to those used in conventional LCD matrix addressed panels. By avoiding the need for microtips, the overall cost of manufacturing the display can be kept to a minimum, especially with large displays. The cathode structure also avoids the need for address lines to cross one another, enabling the structure to be formed simply in one lithographic step. The display does not require any internal partitions, such as is needed in plasma displays to confine the plasma to the addressed pixel, the black mask on the faceplate is sufficient to ensure the necessary contrast. Because of this, manufacture is simplified and the spacing between pixels can be small. High pixel densities are possible, which could exceed 360 dpi.

What we claim is:

1. A display comprising:

a cathode emitter base plate, said base plate having a plurality of gated, cathode structures of linear form, wherein each said cathode structure includes a pair of electrodes separated from one another by a gap between said electrodes and a plurality of electron field emitter sites spaced along its length, such that when a cathode structure is addressed with a voltage, all said emitter sites along said addressed cathode are gated to conduct current across the gap; and a screen, said screen being separated from said base plate by a vacuum gap, and wherein said screen includes a fluorescent layer and a plurality of addressable anode stripes extending transversely of the cathode structures such that a voltage applied to a said anode stripe causes a portion of an electron current at a conducting emitter site below said stripe to be redirected towards said screen to cause illumination of a pixel on said fluorescent layer.

2. A display according to claim 1, wherein each said electrode of said cathode structures includes a plurality of teeth projecting from opposite sides towards an adjacent electrode, and wherein said electron emitter sites are located between said teeth of adjacent electrodes.

3. A display according to claim 1, wherein said fluorescent layer includes regions of phosphors that fluoresce with different colors arranged such that a full color picture can be displayed.

4. A display according to claim 1, wherein said screen has a black material between said fluorescent pixels.

5. A display according to claim 1, wherein each said electron emitter site is provided by a dot of material bridging said gap between the said pairs of electrodes of said cathode structure.

6. A display according to claim 5, wherein the said material is selected from a group comprising: semiconducting diamond, nanotube carbon, gallium nitride and metal oxides.

7. A display according to claim 1, wherein said anode stripes are transparent to light emitted by said fluorescent layer.

8. A display according to claim 7, wherein said fluorescent layer is formed on said anode stripes.

9. A color display comprising:

a cathode emitter base plate, said base plate having a plurality of gated, cathode structures of linear form, wherein each said cathode structure includes a parallel pair of electrodes having teeth projecting from both sides and separated from one another by a gap between said electrodes and an electron emitter material at each said gap, such that when a cathode structure is addressed with a voltage, current flows across each gap via said emitter material; and a screen, said screen being separated from said base plate by a vacuum gap, and wherein said screen includes a plurality of addressable, transparent anode stripes extending transversely of the cathode structures such that a voltage applied to a said anode stripe causes a portion of an electron current at a conducting emitter material below said stripe to be redirected towards said screen, each said anode stripe having phosphor pixels of three different colors deposited on it so that electrons striking different pixels cause illumination of different colors.

* * * * *